US007389708B2

(12) United States Patent
Kajino

(10) Patent No.: US 7,389,708 B2
(45) Date of Patent: Jun. 24, 2008

(54) STARTER FOR AN ENGINE

(75) Inventor: Sadayoshi Kajino, Nagoya (JP)

(73) Assignee: Denso Corporation, Kariya (JP)

( * ) Notice: Subject to any disclaimer, the term of this patent is extended or adjusted under 35 U.S.C. 154(b) by 793 days.

(21) Appl. No.: 11/006,748

(22) Filed: Dec. 8, 2004

(65) Prior Publication Data

US 2005/0139020 A1 Jun. 30, 2005

(30) Foreign Application Priority Data

Dec. 25, 2003 (JP) ..... 2003-429032

(51) Int. Cl.
*F02N 1/00* (2006.01)

(52) U.S. Cl. ..... 74/7 E; 74/7 R

(58) Field of Classification Search ..... 74/6, 74/7 E, 7 R, 7 C
See application file for complete search history.

(56) References Cited

U.S. PATENT DOCUMENTS 4,974,463 A 12/1990 Luiki
5,000,054 A * 3/1991 Morishita et al. ..... 74/6
5,035,151 A 7/1991 Isozumi
5,953,955 A * 9/1999 Shiga et al. ..... 74/7 A
6,239,503 B1 5/2001 Ikeda et al.
2003/0097891 A1* 5/2003 Siems et al. ..... 74/6
2004/0187615 A1* 9/2004 Murata et al. ..... 74/7 E

FOREIGN PATENT DOCUMENTS

JP Y2 6-23742 6/1994
JP A 10-148169 6/1998

* cited by examiner

*Primary Examiner*—David M Fenstermacher
(74) *Attorney, Agent, or Firm*—Oliff & Berridge, PLC

(57) ABSTRACT

A starter for an engine includes a motor, a cylindrical tube, a one-way clutch, an output shaft, and a pinion gear. The motor generates a rotational force. A first bearing rotatably supports the tube. The tube includes a female helical spline on its inner surface. The clutch transfers a rotational force from the motor to the tube. The output shaft has first and second ends axially aligned with a shaft of the motor. The first end has a male helical spline that engages the female helical spline of the tube. A second bearing rotatably and slidably supports the second end of the output shaft. The pinion gear is disposed on the output shaft and is slidable to engage the output shaft and a ring gear on the engine. The output shaft has a straight spline engaging the pinion gear.

11 Claims, 2 Drawing Sheets

STARTER FOR AN ENGINE

CROSS REFERENCE TO RELATED APPLICATIONS

This application is based upon and claims the benefit of priority of Japanese Patent Application No. 2003-429032, filed on Dec. 25, 2003, the contents of which are incorporated herein by reference.

FIELD OF THE INVENTION

This invention relates to a starter having an output shaft fitted inside of a tube with a helical spline and a pinion gear axially aligned therewith, the output shaft freely slidable with the tube in an axial direction.

BACKGROUND OF THE INVENTION

Japanese Patent document JP-H6-6-23742 Y2 discloses a conventional starter. This starter includes, as shown in FIG. 3, an output shaft 120 supported by a bearing 100 on a housing 110. The output shaft 120 is free to rotate and slide axially. A one-way clutch 140 transfers torque from a motor 130 to the output shaft 120. A pinion gear 150 is fit to the end of the output shaft 120 with a spline. The output shaft 120 of this starter is moved to the right in FIG. 3 by a shift lever 160 to engage a ring gear of an engine (not shown) through the pinion gear 150.

In the conventional art disclosed in the above document, the pinion gear 150 is attached to the end of the output shaft 120 that protrudes from the bearing 100 toward the outside of the housing 110 (opposite the clutch 140). In this structure, the one-way clutch 140 and the pinion gear 150 are both supported by the bearing 100. This results in an increased distance between the clutch 140 and the pinion gear 150. Furthermore, the axial distance between the end of the pinion gear 150 to the rear end of the motor 130 is increased. This makes it difficult to mount the starter to the engine because of possible interferences between the starter and the accessories and/or wires.

The output shaft 120 is only supported at one end based on the relative position of the bearing 100 and the pinion gear 150. This structure provides less strength compared to a structure having two bearings supporting both ends of the output shaft 120 such that the pinion gear 150 is located between the two bearings.

In view of the above-described problem, one object of the present invention is to provide a better way to mount the starter by decreasing its axial length between the edge of the pinion gear and the rear end of the motor and also reinforcing the output shaft.

SUMMARY OF THE INVENTION

The starter of the present invention includes a motor, a tube, a one-way clutch, and an output shaft. The motor generates a rotational force. The tube has a cylindrical shape with a female helical spline engraved on its inner surface and freely rotates on a first bearing located outside of the tube. The one-way clutch transfers the rotational force of the motor to the tube. The output shaft is axially aligned with an armature shaft of the motor and has a male helical spline engraved on one end. The male helical spline of the output shaft is disposed in the tube and engages the female helical spline on the inner surface thereof. The other end of the shaft is rotatably and slidably supported by a second bearing provided at a bearing portion of a housing. The output shaft has a straight spline extending between the end supported by the first bearing and the end supported by the second bearing. The spline engages a pinion gear.

According to the above structure, the pinion gear can be disposed between the first and second bearings. This structure has an advantage in that the starter has a axial length compared to a starter that supports the output shaft only on one end because the space between the pinion gear and the one-way clutch can be decreased. In other words, there is no need for the second bearing to be disposed between the pinion gear and the one-way clutch. This enables the pinion gear to be located close to the one-way clutch. As a result, the axial length of the starter between the edge of the pinion gear and the rear end of the motor is reduced and, thus, the starter requires less space and may be more easily mounted.

The structure of the starter also works for the benefit of the strength of the output shaft because it is supported on both ends.

In one aspect of the present invention, the tube stops its rotation relative to the output shaft when the output shaft moves in a direction opposite to the motor and the opposite end of the male helical spline is pressed against a stopper formed as an end of the female helical spline on the inner surface of the tube under the support of the first bearing.

According to the above-described structure, the relative rotation of the tube the output shaft stops substantially simultaneously with the axial movement of the output shaft. That is, there is no need to stop the axial movement of the output shaft forcefully. Therefore, a thrust force created from the output shaft moving in a direction opposite the motor is not directed to the second bearing and/or the housing, thereby improving the durability of the starter.

In another aspect of the present invention, the one-way clutch has an outer portion and an inner portion. The inner portion is formed as part of the tube.

In this structure, loss of torque is reduced because a rotational force of the motor is transferred directly from the outer portion of the one-way clutch to the tube via a roller. Moreover, because the inner portion and the tube are formed as one part, the number of parts can be reduced and the body of the starter can be downsized.

In another aspect of the present invention, a rotational speed of the motor is reduced by a speed reduction device having a planetary gear revolving freely on a shaft fixed to the outer portion of the one-way clutch. This transfers orbital movement of the planetary gear to the outer portion of the one-way clutch.

In this structure, there is no need to have a separate part disposed between the planetary gear and the outer portion of the one-way clutch because a gear shaft is directly disposed on the outer portion. This results in a decreased axial length of the starter. Furthermore, rotational torque is transferred efficiently because orbital movement of the planetary gear is directly transferred to the outer portion of the one-way clutch through the gear shaft.

In yet another aspect of the present invention, the bearing portion of the housing has a through hole that contains the second bearing and a protective cover that axially covers the other end of the output shaft supported by the second bearing and closes an opening of the through hole.

In this structure, sliding performance of the output shaft supported by the second bearing is preserved because the cover protects the inside of the thorugh hole from dust, water, and other forms of foreign matter. The cover also works to contain a lubricant that will ensure a longer period of sliding performance of the output shaft.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

Each of the preferred embodiments will now be described with reference to the drawings.

Figure 1:
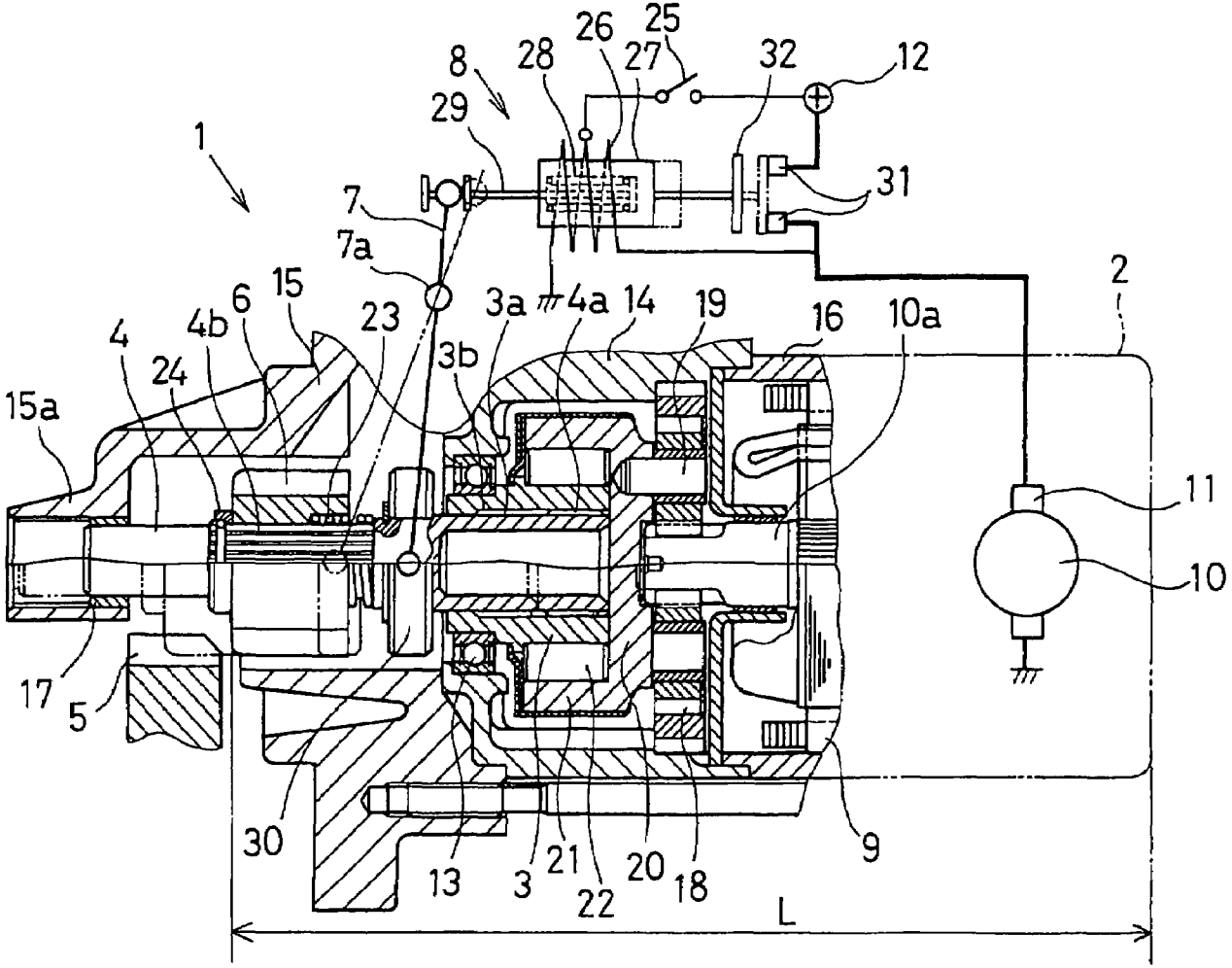
FIG. 1 is a cross-sectional side view of a starter including a schematic diagram of an electrical circuit of the starter according to a first embodiment of the present invention.

FIG. 1 shows a cross section of a starter 1 and a schematic diagram of an electrical circuit of the starter 1 according to a first embodiment of the present invention.

The starter 1 includes a motor 2, an output shaft 4, a tube 3, a pinion gear 6, a ring gear 5, an electro-magnetic switch 8, and a shift lever 7. The motor 2 produces a rotational force. The output shaft 4 receives the rotational force of the motor 2 through the tube 3. The pinion gear 6 transfers the rotational force to the ring gear 5 of an engine by rotating together with the output shaft 4. The electromagnetic switch 8 controls switching of a main contact point (described later) of the electrical circuit for the motor 2 besides sliding the output shaft 4 axially with the shift lever 7.

The motor 2 is a conventional direct current electric motor that includes a field generator 9, an armature 10, and a brush 11. The field generator 9 generates a magnetic field. The armature 10 has a rectifier (not shown). The brush 11 is disposed on the rectifier. When the main contact point is closed by the electro-magnetic switch 8, a current is supplied from a battery 12 to the motor 2 to generate a rotational force in the armature 10.

The tube 3 has a cylindrical shape with a female helical spline 3*a* on its inner circumferential surface. The tube 3 has a bearing surface with a decreased diameter on an end opposite the motor (i.e., the left side in FIG. 1). The bearing surface is supported by a center case 14 through a ball bearing 13 (the first bearing of the present invention) fitted to the outer circumference of the bearing surface. The tube 3 is freely rotatable on the bearing. The female helical spline 3*a* does not go through to the other end of the tube 3 because a stopper 3*b* is disposed thereon.

The center case 14 is disposed between the housing 15 and a motor yoke 16 of the starter 1. The center case 14 covers the outside of a speed reduction device and a clutch, which is described in detail later.

The output shaft 4 is axially aligned with an armature shaft 10*a* of the motor 2 through the speed reduction device and the clutch and has a male helical spline 4*a* on the outer circumferential surface of one end. The male helical spline 4*a* engages the female helical spline 3*a* on the inner circumference of the tube 3. The other end of the output shaft 4 is rotatably and slidably supported by a bearing 17 (the second bearing of the present invention) that is press-fit into the bearing portion 15*a* of the housing 15. The output shaft 4 has a straight spline 4*b* extending between the one end supported by the ball bearing 13 and the other end supported by the bearing 17.

The bearing 17 disposed on the bearing portion 15*a* of the housing 15 includes a metal bushing. An axial length of the bearing 17 is chosen to be sufficient for the output shaft 4 to always be covered by the bearing 17, as shown in FIG. 1. That is, the edge of the output shaft 4 and a side of the bearing 17 that is opposite to the pinion 6 are positioned substantially flush when the starter 1 is stopping (as shown in FIG. 1). Therefore, the edge of the output shaft 4 protrudes from the bearing 17 beyond the side that is opposite to the pinion 6 when the output shaft 4 is pushed away from the motor 2. In this structure, the inner circumferential surface of the bearing 17 is not exposed to the atmosphere even when the starter 1 is stopping and, thus, the surface is protected from dust, water, and any other undesirable foreign matter.

The speed reduction device includes a conventional planetary gear set having multiple planetary gears 18. When a rotation of the armature 10 is transferred to the planetary gear 18, the speed of the rotation is reduced to the orbital speed of the planetary gear 18. This is because the planetary gears 18 orbit around the armature shaft 10*a*. The planetary gear 18 is rotatably supported by a gear shaft 19. The shaft 19 is fixed onto a carrier plate 20 by press-fit or similar means.

The clutch includes an outer portion 21 that rotates with the orbital movement of the planetary gear 18, an inner portion that is formed as the tube 3, and a roller 22 that is disposed between the outer 21 and the inner portions (the tube 3). The clutch transfers torque from the outer portion 21 to the inner portion through the roller 22 and cuts off torque from the inner portion to the outer portion 21. The outer portion 21 has a sidewall that partitions the armature shaft 10*a* of the motor 2 from the axially opposing output shaft 4. This sidewall serves as the carrier plate 20. A side of the carrier plate that is opposite to the motor 2 (i.e., the left side of the wall in FIG. 1) is used as a stopper wall for a backward (i.e., to the right in FIG. 1) movement of the output shaft 4.

The pinion gear 6 engages the straight spline 4*b* on the outer circumference of the output shaft 4 to be rotated therewith. Furthermore, the pinion gear 6 abuts a collar 24 attached to the output shaft 4 at the front edge of the pinion gear 6 by pressure from a pinion spring 23 in a direction opposite to the motor (to the left in FIG. 1). In this case, the pinion gear 6 pushes the pinion spring 23 to the right in FIG. 1 into a fully compressed state by sliding along the straight spline 4*b* on the output shaft 4. In other words, backward movement of the pinion gear 6 is restricted by a displacement amount corresponding to the fully compressed states of the pinion spring 23.

The electromagnetic switch 8 includes an exciting coil 26, a plunger 27, a lever hook 29, and a drive spring 28. The exciting coil 26 receives a current from the battery 12 by a closing operation of a starter switch 25 (an IG key). The plunger 27 is disposed in the exciting coil 26 for back and forth movement. The lever hook 29 is disposed on a concave portion of the plunger 27 through the drive spring 28. A top end of the shift lever 7 is connected to the lever hook 29 (shown in FIG. 1).

The shift lever 7 pivots on a fulcrum 7*a* and is associated with a pair of washer members 30 on the output shaft 4 at the lower end thereof to transfer the movement of the plunger 27 to the output shaft 4.

The main contact point of the motor 2 includes a pair of fixed contact points 31 and a moving contact point 32. The pair of fixed contact points 31 are connected through two external terminals (not shown) of the electro-magnetic switch 8 to a power circuit. The moving contact point 32 is associated with the plunger 27 (or formed as a part of the plunger 27). The main contact point closes when the moving contact point 32 is pressed against the pair of fixed contact points 31 to establish an electrical connection between the two fixed contact points 31. The main contact point opens when the moving contact point 32 departs from the pair of fixed contact points 31.

The operation of the starter 1 will now be described.

When a current is supplied to the exciting coil 26 of the electro-magnetic switch 8 by closing the starter switch 25, the plunger moves to the right in FIG. 1 due to an attractive magnetic force created by the exciting coil 26. This compresses a return spring (not shown) to push the output shaft 4 in a direction opposite the motor through the shift lever 7. If the pinion gear 6 smoothly engages the ring gear 5, as shown by the double-dashed line in FIG. 1, the moving contact point 32 presses against the pair of fixed contact points 31 to close the main contact point and, thus, a rotation force is generated in the armature 10.

On the other hand, when an edge of the pinion gear 6 reaches the face of the ring gear 5 before engaging with the ring gear 5, only the output shaft 4 moves forward. This further compresses the pinion spring 23 leaving the pinion gear 6 (the pinion gear moves backward relative to the output shaft 4). As the pinion gear 6 rotates with the movement of the output shaft 4, it becomes firmly engaged with the ring gear 5 by the pressure from the pinion spring 23 and, thus, the main contact point is closed to yield a rotation force in the armature 10.

Even when the pinion gear 6 and the ring gear 5 are not engaged prior to closing the main contact point, the rotational force of the armature 10 of the motor 2 rotates the output shaft 4, thereby resulting in relative rotation of the pinion gear 6 and the ring gear 5. The pinion gear 6 and the ring gear 5 therefore become engaged firmly with the assistance of both the pinion spring 23 and the drive spring 28. When the pinion gear 6 and the ring gear 5 are firmly engaged, a rotation force is transferred from the pinion gear 6 to the ring gear 5 to finally crank the engine.

When the starter switch 25 is opened after starting the engine, the plunger 27 moves to the left in FIG. 1 by a pressure from the return spring because of the loss of the attractive magnetic force from the exciting coil 26. The plunger movement opens the main contact point to cut the current supplied to the armature 10. The shift lever 7 pushes the output shaft 4 back to the right in FIG. 1, resulting in the pinion gear 6 disengaging the ring gear 5 and the output shaft 4 contacting the carrier plate 20. The starter 1 has a straight spline 4*b* between the end of the output shaft 4 supported by the ball bearing 13 through the tube 3 and the other end supported by the bearing 17. The pinion gear 6 engages the spline 4*b*. Therefore, the output shaft 4 is supported on both ends and, hence, the pinion gear 6 and the clutch can be disposed close to each other because there is no need to dispose a bearing therebetween.

Figure 3:
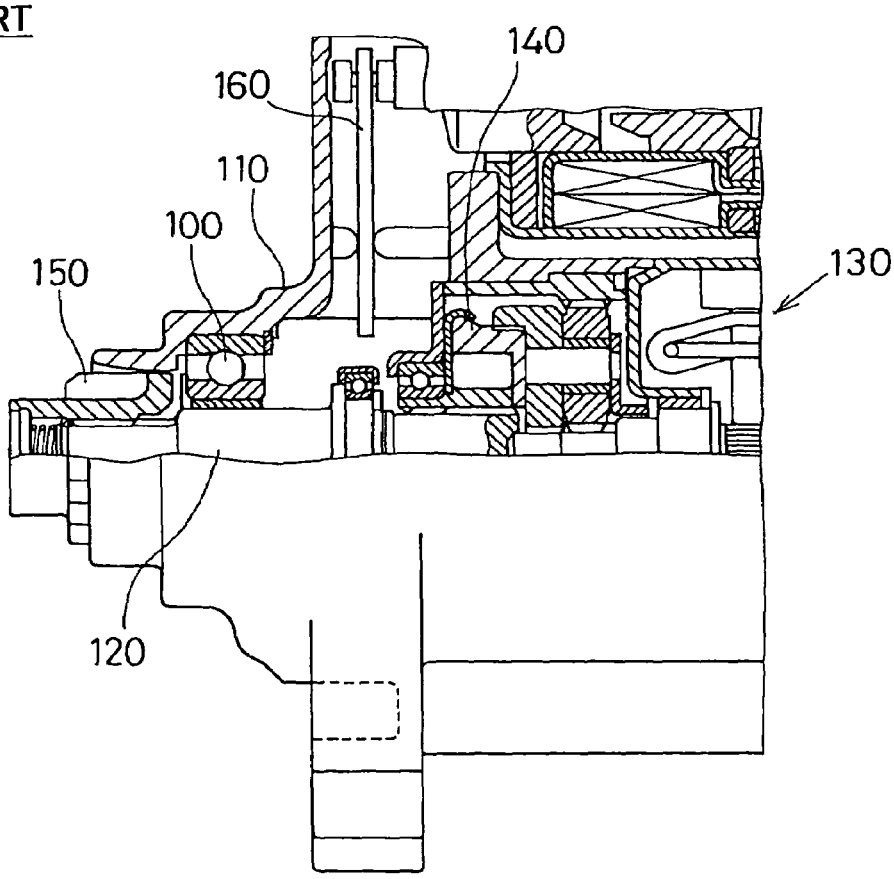
FIG. 3 PRIOR ART
FIG. 3 is a partial cross-sectional side view of a conventional starter.

Compared to the conventional starter, which is shown in FIG. 3 and described above, the starter 1 of the present invention is easier and more soundly mounted to an engine because of its reduced axial length L (shown in FIG. 1) between the edge of the pinion gear 6 and the rear end of the motor 2. The starter 1 in the first embodiment includes a motor 2 armature shaft 10 and output shaft 4 that are axially aligned and, therefore, have a longer axial length. Hence, reducing the axial length L of the output shaft and supporting it on both ends has an enormous impact in terms of the integrity of the mount and the strength of the output shaft structure.

In the starter 1 of the first embodiment, an edge of the male helical spline 4*a* on the output shaft 4 is rotationally engaged to an edge (stopper 3*b*) of the female helical spline on the inner circumference of the tube 3. This engagement stops the rotation of the output shaft 4 relative to the tube 3 and sliding movement of the output shaft 4 in the axial direction. According to this structure, the movement in the axial direction does not have to be stopped forcefully. That means, a thrust force of the output shaft 4 in the direction opposite to the motor does not have to be born by the bearing 17 or the housing 15 and, thus, the durability of the starter 1 is improved with the bearing 17 and the housing 15 being free from excessive loads.

Furthermore, the clutch that transfers a rotational force of the motor 2 to the output shaft 4 includes an integrally casted part consisting of the inner portion and the tube 3. In this case, torque losses due to the transfer are reduced because the rotational force of the motor 2 is directly transferred from the outer portion 21 to the tube 3 through the roller 22. Moreover, because the inner portion and the tube 3 are integrally formed, the number of parts can be reduced and the body of the starter can be downsized.

Furthermore, because the carrier plate 20 supporting the gear shaft 19 of the planetary gear 18 and the side wall of the outer portion 21 are integrally formed, rotational torque created by the orbital movement of the planetary gear 18 is transferred efficiently to the outer portion 21 through the gear shaft 19. This also helps in reducing the axial length of the starter.

Because the side-wall of the outer portion 21 (the carrier plate 20) covers the edge of the output shaft 4 closest to the motor, the engaging portion (sliding portion) disposed between the female helical spline 3*a* and the male helical spline 4*a* can be completely separated from the motor 2. As a result, the sliding portion of the spline can be protected from brush and abrasion powders of the gear from inside of the motor 2.

Figure 2:
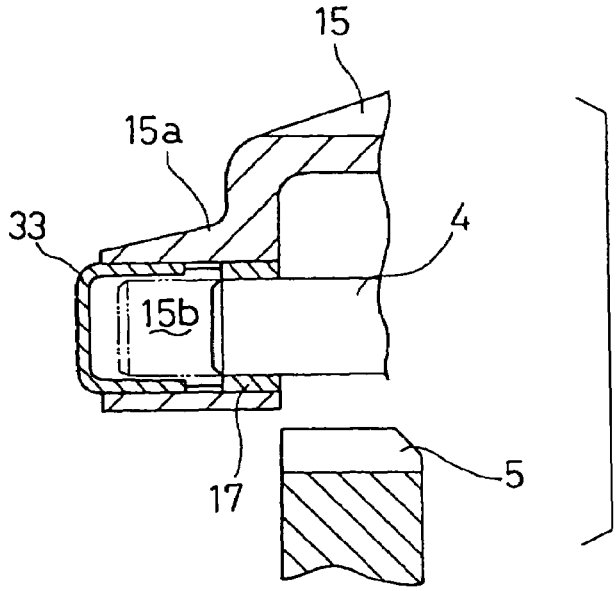
FIG. 2 is a cross-sectional side view of a portion of the starter of FIG. 1 showing a condition of a protective cover according to a second embodiment of the present invention.

FIG. 2 shows a cross-sectional view of a protective cover 33 mounted on the bearing portion 15*a* of the.

The bearing portion 15*a* of the housing 15 includes a through hole 15*b* for receiving the bearing 17. The protection cover 33 covers the front end of the through hole 15*b* to close an opening on the front end thereof. In this structure, sliding performance of the output shaft 4 supported by the bearing 17 is preserved because the cover protects the inside of the through hole 15*b* from dust, water, and/or other foreign debris. The cover 33 also works to contain lubricant that ensures a longer period of sliding performance.

In the first embodiment, the metal bush (plain bearing) is taken as an example of the bearing 17. However, a needle bearing, a ball bearing, or any other type of device operable to serve the principles of the present invention may be used instead.

Furthermore, although the length of the bearing 17 has been described as being shorter than the bearing portion 15*a* of the housing 15 in order to prevent exposing the inner surface of the bearing 17 while the starter 1 is stopping, it should be appreciated that in an alternative embodiment the length of the bearing 17 may be the same as the total length of the bearing portion 15*a* or even larger.

Therefore, it should be appreciated that the starter 1 of the present invention has a structural advantage of supporting the pinion shaft on both ends to increase the accuracy of its axial position and its durability. Furthermore, a mechanical advantage that comes from the shift lever connecting mechanism with the output shaft by using a bearing and a helical spline in terms of reducing rotational friction between the shift lever and the output shaft, and in terms of reducing sliding momentum of the pinion gear and resulting in a downsizing of the magnetic switch.

What is claimed is:

1. A starter comprising:

a motor that generates a rotational force;

a tube rotatably supported by a first bearing, the tube having a female helical spline engraved on an inner surface;

a one-way clutch that transfers the rotational force of the motor to the tube;

an output shaft axially aligned with a shaft of the motor and having a first end and a second end, the first end having a male helical spline engraved thereon engaging the female helical spline of the tube, the second end rotatably and slidably supported by a second bearing provided at a bearing portion of a housing; and a pinion gear disposed on the output shaft and slidable toward the engine to engage a ring gear disposed thereon together with the output shaft, wherein the output shaft has a straight spline extending between the first end and the second end engaging the pinion gear.

2. The starter of claim 1, wherein the tube stops rotating relative to the output shaft when the output shaft moves axially away from the motor and the male helical spline is press-fit against a stopper formed on an end of the female helical spline of the tube supported by the first bearing.

3. The starter of claim 1, wherein the one-way clutch has an outer portion and an inner portion, the inner portion being integrally formed with the tube.

4. The starter of claim 3, wherein a rotational speed of the motor is reduced by a speed reduction device that has a planetary gear revolving freely on a shaft fixed onto the outer portion of the clutch, thereby transferring torque generated by orbital movement of the planetary gear to the outer portion of the clutch.

5. The starter of claim 1, wherein the bearing portion of the housing has a through hole containing the second bearing and a protection cover axially covering the second end of the output shaft and closing an opening of the through hole.

6. A starter comprising:

a motor that generates a rotational force;

a tube rotatably supported by a first bearing;

a one-way clutch that transfers the rotational force from the motor to the tube;

an output shaft axially aligned with a shaft of the motor and having a first end and a second end, the first end received by and engaging the tube, the second end rotatably and slidably supported by a second bearing; and a pinion gear disposed on the output shaft and slidable toward the engine to engage a ring gear disposed thereon together with the output shaft, wherein the output shaft has a straight spline extending between the first end and the second end engaging the pinion gear.

7. The starter of claim 6, wherein the tube includes a female internal helical spline engaging a male external helical spline on the output shaft.

8. The starter of claim 2, wherein the one-way clutch has an outer portion and an inner portion, the inner portion being integrally formed with the tube.

9. The starter of claim 2, wherein the bearing portion of the housing has a through hole containing the second bearing and a protection cover axially covering the second end of the output shaft and closing an opening of the through hole.

10. The starter of claim 3, wherein the bearing portion of the housing has a through hole containing the second bearing and a protection cover axially covering the second end of the output shaft and closing an opening of the through hole.

11. The starter of claim 4, wherein the bearing portion of the housing has a through hole containing the second bearing and a protection cover axially covering the second end of the output shaft and closing an opening of the through hole.

* * * * *